US007959187B2

(12) United States Patent
Flynn et al.

(10) Patent No.: US 7,959,187 B2
(45) Date of Patent: Jun. 14, 2011

(54) LABEL ASSEMBLY FOR APPLYING A LABEL TO AN OBJECT

(75) Inventors: Timothy J. Flynn, Key Largo, FL (US); Michael Strauss, Somerset, NJ (US)

(73) Assignee: Continental Datalabel, Inc., Elgin, IL (US)

( * ) Notice: Subject to any disclaimer, the term of this patent is extended or adjusted under 35 U.S.C. 154(b) by 423 days.

(21) Appl. No.: 11/585,654

(22) Filed: Oct. 24, 2006

(65) Prior Publication Data

US 2008/0093839 A1 Apr. 24, 2008

(51) Int. Cl.
*B42D 15/00* (2006.01)
*G09F 3/00* (2006.01)

(52) U.S. Cl. ..... 283/81; 283/67; 283/70; 283/71

(58) Field of Classification Search ..... 40/124.06; 156/60, 247, 248, 249, 391, 556, 580, DIG. 1, 156/DIG. 2; 206/232, 308.1; 229/92.8; 428/40.1, 428/41.1, 41.2, 42.1, 42.2, 42.3; 281/51; 283/71, 81, 117, 67, 70; *B42D 15/00; B65C 1/00, B65C 1/02; B65D 71/00, 85/30; G09F 1/00*
See application file for complete search history.

(56) References Cited

U.S. PATENT DOCUMENTS 6,073,377 A 6/2000 Mehta
6,479,118 B1 11/2002 Atkinson
6,776,866 B2 * 8/2004 Flynn et al. ..... 156/247
7,140,136 B2 * 11/2006 Flynn et al. ..... 283/81
2006/0011076 A1 * 1/2006 Durban ..... 101/127
2006/0032764 A1 * 2/2006 Swenson ..... 206/232

OTHER PUBLICATIONS

Co-Pending U.S. Appl. No. 11/716,388, filed Mar. 9, 2009.
Co-pending U.S. Appl. No. 12/426,816, titled "Label Assembly for Applying a Label to and Around a Portion of an Object," filed Apr. 20, 2009.
Co-pending U.S. Appl. No. 12/426,823, titled "Label Assembly for Applying a Label to an Object," filed Apr. 20, 2009.
Co-pending U.S. Appl. No. 12/581,660, titled "Label Assembly Having Angled Registration Tabs for Applying a Label to an Object," filed Oct. 19, 2009.
Co-pending U.S. Appl. No. 12/581,672, titled "Label Assembly Having Raisable Registration Tabs Disposed Over Removeable Shapes," filed Oct. 19, 2009.

* cited by examiner

*Primary Examiner* — Dana Ross
*Assistant Examiner* — Justin V Lewis
(74) *Attorney, Agent, or Firm* — Pauley Petersen & Erickson

(57) ABSTRACT

A label assembly that includes a face sheet with at least one label shape defined by one or more tearable lines of separation, a back sheet adjacent to the face sheet, and an adhesive material disposed between the face sheet and the back sheet. The back sheet has a removable panel disposed over the label shape adhesive material and a registration structure aligned with the label shape. The registration structure is raised or raisable above the back sheet to allow an object for labeling to be positioned against the registration structure for proper alignment with the label. Once positioned against the registration structure, the object can be rolled over the adhesive coated back of the label to apply the label to the surface of the object.

20 Claims, 4 Drawing Sheets

LABEL ASSEMBLY FOR APPLYING A LABEL TO AN OBJECT

FIELD OF THE INVENTION

This invention is directed to a label assembly for application of a label to a non-planar, e.g., rounded, surface, such as a pen or pencil. The invention is also directed to a printable sheet of such labels, and a method for printing and applying the printed labels, such as by a consumer.

SUMMARY OF THE INVENTION

A general object of the invention is to provide a label assembly for applying a label to a non-planar surface, such as, for example, a pen or pencil having a cylindrical or conical shaft, or a circular, ovular, rectangular, square, hexagonal, octagonal, or other shaped cross-section.

The general object of the invention can be attained, at least in part, through an improvement to a label assembly that includes a face sheet with at least one label shape defined by at least one tearable line of separation, a back sheet adjacent to the face sheet, and an adhesive material disposed between the face sheet and the back sheet. The improvement includes the back sheet having a removable panel disposed over the label shape and a registration structure aligned with the label shape and the removable panel. The registration structure is one of raised or raisable above the back sheet, to allow the object to be labeled to be positioned against the registration structure for proper alignment with the label.

The invention further comprehends a label assembly. The label assembly includes a face sheet having a printable surface and an adhesive material coating a surface opposite the printable surface. A label shape is defined in the face sheet by first tearable lines of separation. A back sheet is disposed over the adhesive material. The back sheet includes a first surface opposite the adhesive material, a removable panel defined in the first surface by second tearable lines of separation and disposed over the label shape, and a remaining portion disposed around the removable panel.

The back sheet also includes more than one retainer tab extending from the remaining portion and adhering to the label shape. The retainer tab(s) are particularly useful in holding the label shape in place while removing the removable panel to expose the adhesive material on the label shape. A registration structure is aligned with the label shape, and generally, before removal, also the removable panel. The registration structure is one of raised or raisable above the back sheet first surface, to allow the object to be labeled to be positioned against the registration structure for proper alignment with the label.

The invention still further comprehends a method for labeling an object having a non-planar surface, such as, for example, a pen, pencil, crayon, or glass rod. The method uses a label assembly that includes a face sheet, a back sheet, and an adhesive material between the face and back sheets. The face sheet includes a printable surface opposite the back sheet and a label shape defined in the printable surface by first tearable lines of separation. The back sheet includes a first surface opposite the face sheet and a removable panel defined in the first surface by second tearable lines of separation and disposed over the label shape. The label assembly further includes a registration structure aligned with the label shape and the removable panel.

The method begins with routing the label assembly through a printer and printing on the label shape. Next, the removable panel is removed to expose the adhesive material on the label shape. The object being labeled is placed against the registration structure and rolled from the registration structure across the label shape to contact the non-planar surface to the adhesive material, thereby adhering the label shape to the object.

Other objects and advantages will be apparent to those skilled in the art from the following detailed description taken in conjunction with the appended claims and drawings.

DETAILED DESCRIPTION OF THE INVENTION

Figure 1:
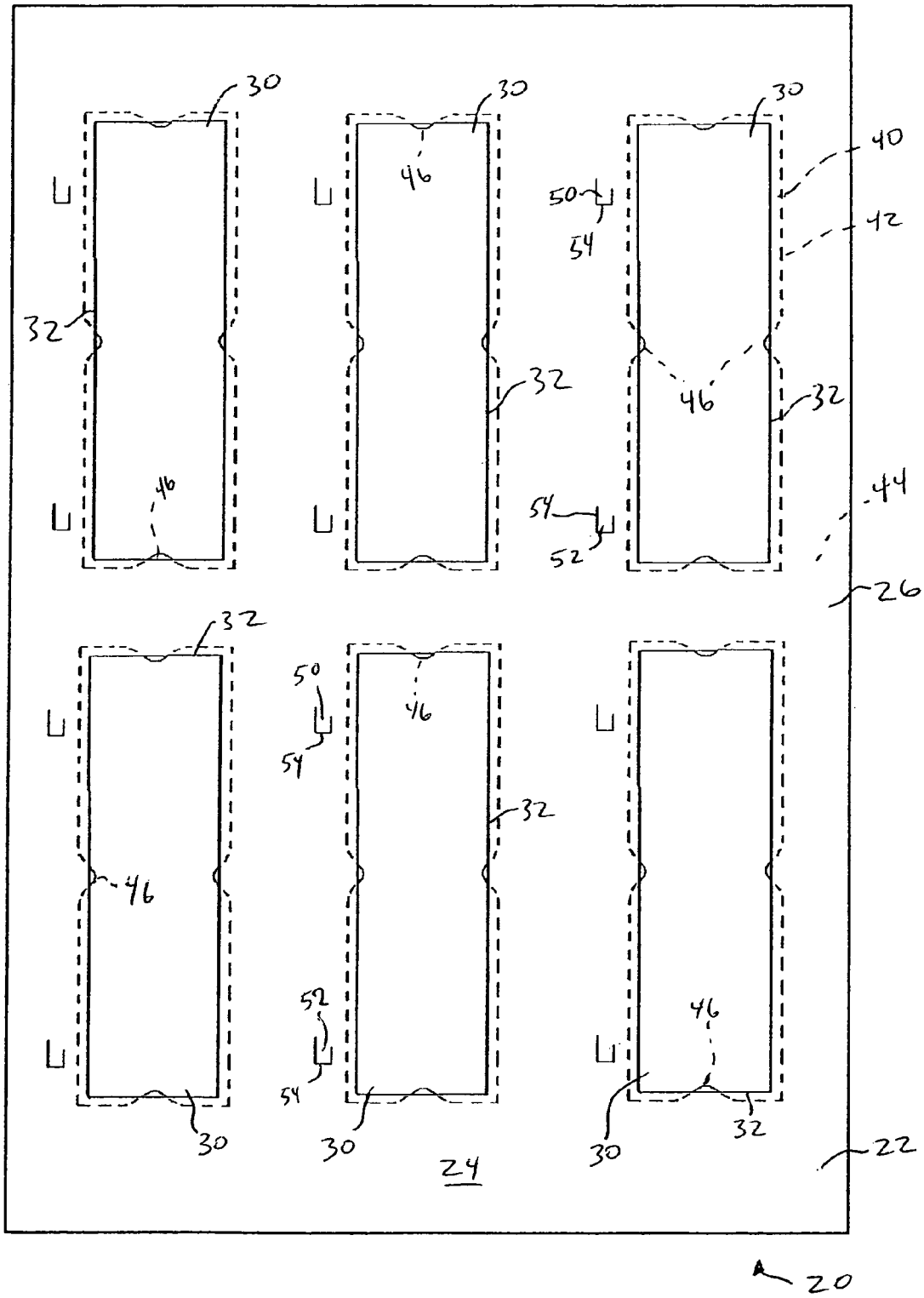
FIG. 1 is a plan view of a label assembly according to one embodiment of this invention.

FIG. 1 shows a label sheet 20 (not necessarily shown to scale) according to one embodiment of this invention. Label sheet 20 is desirably formed of a face sheet 22 and a back sheet (not shown in FIG. 1). The back sheet is desirably about the same size as the face sheet 22, but may be slightly larger or smaller than the face sheet 22. The surface of the face sheet 22 that is disposed toward the back sheet includes an adhesive material coating. The adhesive coating can include any adhesive material known and available to those skilled in the art for forming pressure sensitive, or self-adhesive labels. The back sheet is desirably formed of a material to which the adhesive coating adheres significantly less than to the face sheet 22, such as is known for forming pressure sensitive, or self-adhesive labels.

The sheet 20 is of any suitable shape, and generally any suitable size that can be accepted by and fed through a printer, such as a laser printer or an ink jet printer. Common sizes of paper generally fed through printers are 8.5 inches by 5.5 inches, 8.5 inches by 11 inches, 8.263 inches by 11.688 inches (A4 size), and 8.5 inches by 14 inches. The face sheet 22 is preferably, but not necessarily, constructed of any suitable paper, paper composite, non-metal and/or metal material that can be used as a label. Other suitable materials for constructing the sheet 22 include fabric, plastic, and metal foils. The adhesive coating covered by the back sheet is applied to the face sheet 22 in any suitable manner known to those skilled in the art. The face sheet 22 desirably has a printable surface 24 on a side opposite the adhesive coating.

The face sheet and the printable surface 24 can be any of a variety of face materials used to make pressure sensitive, or self-adhesive labels. Such face materials may include, but are not limited to: smudgeproof stock, litho stock, cast coated stock, tag stock, fluorescent stock, foils, computer printable polyester, vinyl, satin cloth, Tyvek™ material, flexible plastic, book papers, photo quality papers and/or photo quality film. Furthermore, various portions of the face materials can be different colors, thereby resulting in different colored parts.

The phrase "printable surface" relates to a surface of any type of matter upon which a person or machine can draw, print, color, paint, photocopy, write, emboss, or make any other type of mark or graphic. Laser printers, ink jet printers, impact printers, thermal transfer printers, direct thermal printers, typewriters, or any other suitable graphic printing devices are preferred but not necessary for use with printable surfaces according to this invention.

The face sheet 22 includes a plurality of label shapes 30, each defining in the face sheet 22 an individual label according to this invention. The phrase "shape", or the phrase "removable or tearable shape", is intended to relate to a shape, such as, but not limited to, the rectangular shapes identified in FIG. 1 by element reference numerals 30, that can be torn away from a remaining portion 26 of the face sheet 22, by using tearable lines of separation 32. Tearable lines 32 can be formed as any cutting in face sheet 22 known to those skilled in the art, such as die-cut lines, perforated lines, micro-perforated lines, or any combination of these types of separation, or any other suitable structure that enables separation. A preferred type of tearable line 32 is a line that is die-cut. The label shapes 30 can be die-cut along at least a portion of a periphery, such that the label shapes 30 can be easily removed or separated from the remaining portion 26 of the sheet 22, for example after the sheet 22 is run through a printer.

The back sheet includes a removable panel 40 shown in phantom. The removable panel is defined by tearable lines of separation (shown as dashed lines 42 in FIG. 1) in a surface of the back sheet that is disposed opposite the front sheet 22. A removable panel 40 is disposed over the adhesive coated side of each label shape 30. In the embodiment shown in FIG. 1, the removable panel 40 is desirably and optionally sized slightly larger than the label shape 30. A remaining portion 44 of the back sheet that is disposed around, and desirably surrounding, the removable panel 40 includes a plurality of retainer tabs 46 extending from the remaining portion 44 and adhering to the label shape 30.

The label sheet 20 includes a registration structure, embodied in FIG. 1 as two spaced apart tabs 50 and 52, aligned with each label shape 30 and the removable panel 40. As will be described in more detail below, the registration structure of this invention allows for improved and easier application of a label to an object with a non-planer surface, for example, a pen or a pencil. In the embodiment of FIG. 1, the tabs 50 and 52 are each defined on three sides by a tearable line of separation 54 in both the back sheet and the face sheet 22. The tabs 50 and 52 are raisable to an extended position by folding outward above the back sheet.

Figure 2:
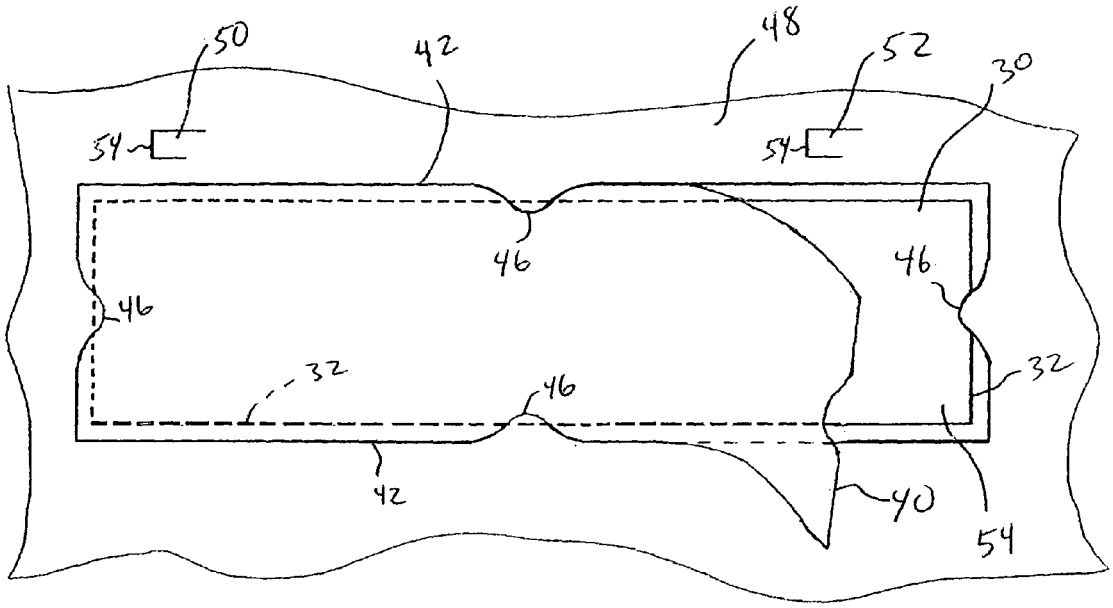
FIG. 2 is a plan view of a portion of the label assembly of FIG. 1, viewed from an opposite side.
Figure 3:
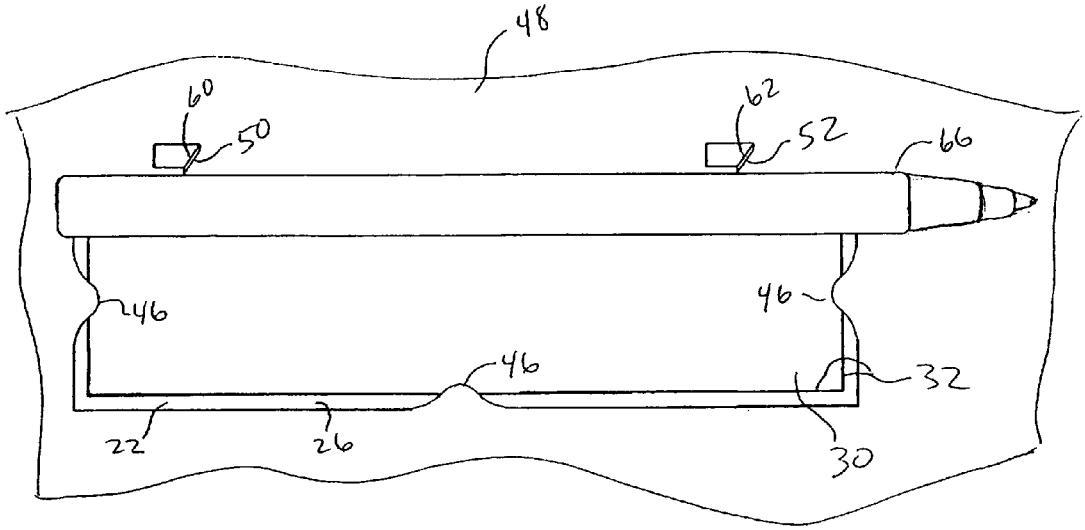
FIGS. 3 and 4 illustrate an operation of the label assembly of FIG. 1.
Figure 4:
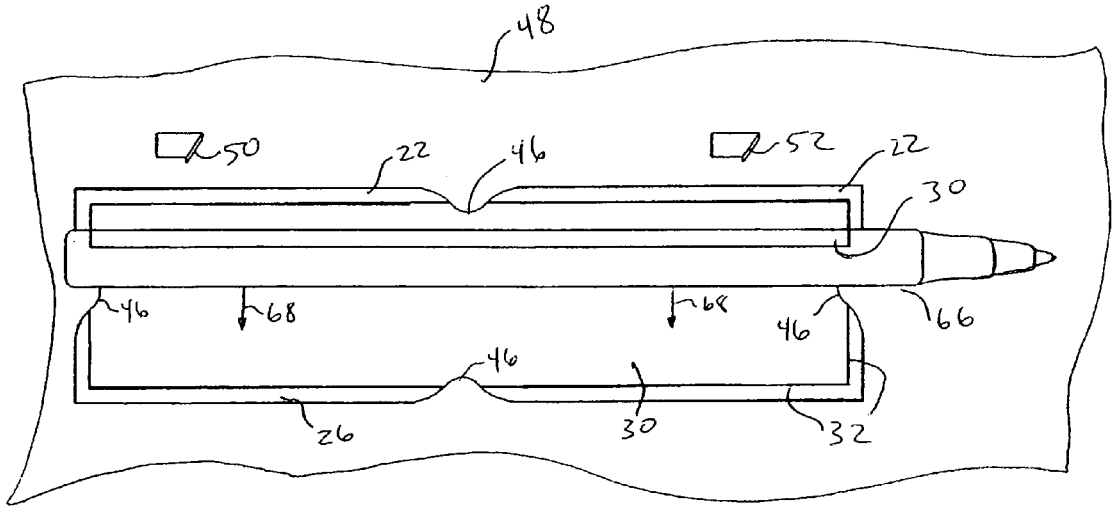

FIGS. 2-4 illustrate the operation of the label sheet 20 of FIG. 1 for labeling an object having a non-planar surface, shown as a pen. Desirably first, the label sheet 20 is routed through a printer to print text and/or graphics onto the printable surface 24 of at least one label shape 30. FIG. 2 shows a printed label shape 30 of sheet 20 placed with the printed face sheet 22 downward on a surface. The removable panel 40 of back sheet 48 is removed along lines of separation 42 to expose the adhesive material 54 on the non-printed side of the label shape 30.

As shown in FIGS. 3 and 4, the tabs 50 and 52 of the registration structure are raised by the user above the surface of the back sheet 48. The tabs 50 and 52 are raised by folding along fold lines 60 and 62, respectively. FIG. 3 shows the label sheet 20 with the removable panel 40 removed and a pen 66 placed against the tabs 50 and 52. As discussed above, desirably the tabs 50 and 52 are formed by one or more die cuts that extend through both of the back sheet 48 and the face sheet 22, thereby desirably providing increased tab thickness and thus rigidity for receiving the pen 66 there against. With the pen 66 against the raised tabs 50 and 52, the pen may or may not be in contact with the adhesive material on the label shape 30 and/or the remaining portion 26. The tabs 50 and 52 desirably assist the user in positioning the pen 66 in proper alignment with the label shape 30 to promote or provide a desirable straight label application. The retainer tabs 46 assist in maintaining the label shape 30 within the face sheet 22 upon removing the removable panel 40 and during positioning of the pen 66 against the tabs 50 and 52.

To apply the label shape 30 to the pen 66, the pen 66 is rolled by the user from the tabs 50 and 52 across the label shape 30, in the direction shown by arrows 68 in FIG. 4. As the pen 66 is rolled, the adhesive material 54 of the label shape 30 adheres to the cylindrical shaft of the pen 66, thereby separating and removing the label shape 30 from the face sheet 22 and adhering the label shape 30 around the pen 66. Thus, the label 30 can be simply and straightly applied to a rounded or other non-planar surface manually by a user. The apparatus and method of this invention can also be incorporated into an automatic or manual label application machine.

The removable panel and the registration structure of this invention allow for relatively easier and better placement of a label onto a rounded or otherwise non-planar surface. As will be appreciated by those skilled in the art following the teachings herein provided, various and alternative sizes, shapes, and configurations are available for the labels, removable panels, and registration structures according to this invention, such as, without limitation, shown in FIGS. 5 and 6.

Figure 5:
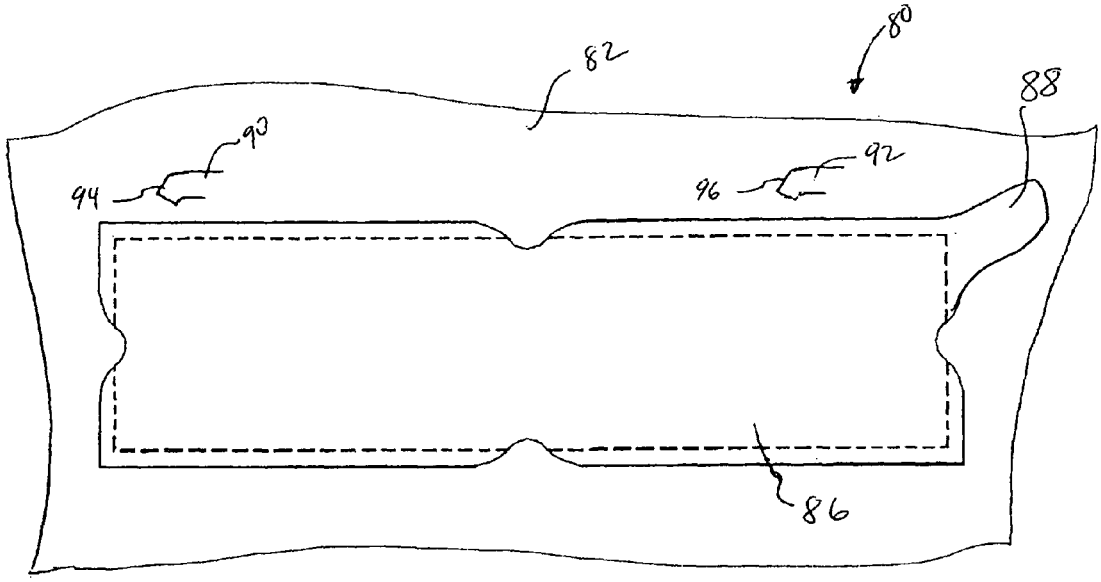
FIG. 5 is a plan view of a portion of a label assembly according to another embodiment of this invention.

FIG. 5 illustrates a portion of a label sheet 80, viewed from the back sheet 82, according to another embodiment of this invention. The label sheet 80 differs from the embodiment of FIG. 1 in the shape of tabs 90 and 92 of the registration structure and removable portion 86. In the embodiment of FIG. 5, the tabs 90 and 92 have bent portions 94 and 96, respectively, that can, for example, desirably form a flat edge that in the raised position is perpendicular to the back sheet 82 and against which a pen or similar object can be placed. In a similar embodiment, the tabs can be formed as hook-like tabs that include a portion that extends over and/or around a portion of the pen or pencil. Also in the embodiment of FIG. 5, the removable portion 86 includes a corner starter flap 88 that is adapted to allow for easier removal of the removable panel 86 by the user.

Figure 6:
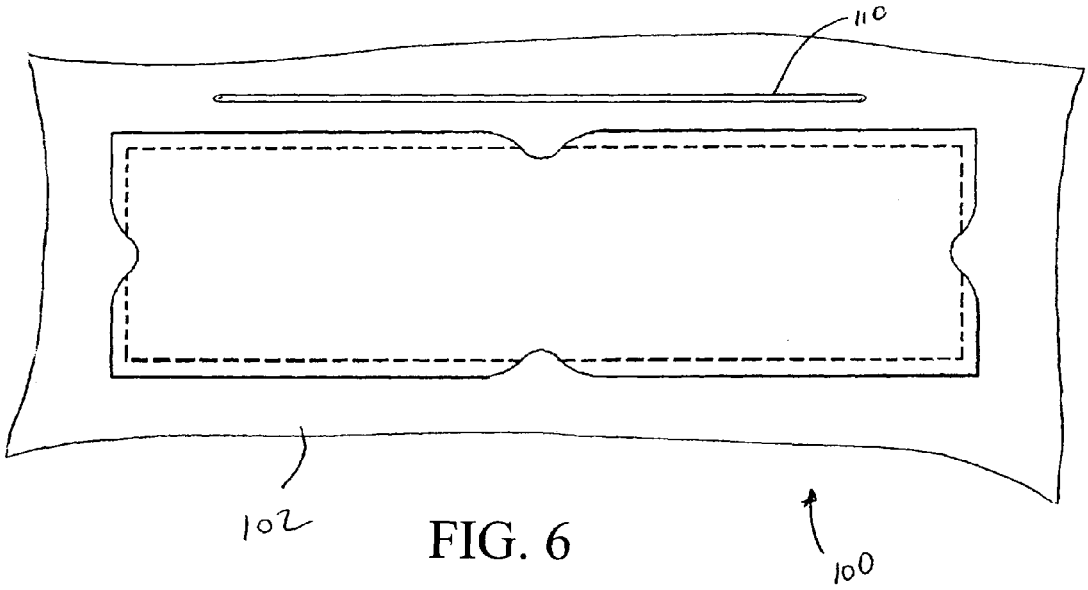
FIG. 6 is a plan view of a portion of a label assembly according to yet another embodiment of this invention.

Other structures than cut-out tabs are available for the registering structure according to this invention. In one embodiment, the registration structure comprises an embossed structure. FIG. 6 shows a label sheet 100 having an embossed structure according to one embodiment of this invention. In FIG. 6, the label sheet 100 includes a back sheet 102. A score line 110 is embossed into the label sheet 100 to provide a raised registration structure against which a pen or other object can be placed for alignment. Desirably, the score line 110 is only as high as is needed for the user to determine when an object is being placed against it. The score line 110 can be formed by scoring the face sheet of the label sheet 100 to cause the score line 110 to be raised above the flat back surface of the label sheet 100 (desirably without cutting through the label sheet 100). As will be appreciated, other embossed or raised shapes are available for the embossed registration structure of this invention, such as, for example, two or more raised domes. Any structure that is or can be raised above the label assembly of this invention, can be used as a registration structure for aligning an object, and is contemplated herein.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. In a label assembly including a face sheet with at least one label shape defined by at least one tearable line of separation, a back sheet adjacent to the face sheet, and an adhesive material disposed between the face sheet and the back sheet, the improvement comprising:

the back sheet including a removable panel disposed over a portion of the adhesive material on the label shape; and a registration structure formed in the back sheet for aligning an object to be labeled adjacent to the portion of the adhesive material on the label shape upon removal of the removable panel, the registration structure disposed outside of an outer periphery of the removable panel and aligned with the removable panel, and the registration structure one of raised or raisable above the back sheet.

2. The label assembly according to claim 1, further comprising a plurality of label shapes, each of the plurality of label shapes associated with a removable panel and a registration structure.

3. The label assembly according to claim 1, wherein the removable panel is sized larger than the label shape.

4. The label assembly according to claim 1, wherein the back sheet comprises a remaining portion disposed around the removable panel and more than one retainer tab extending from the remaining portion and adhering to the label shape.

5. The label assembly according to claim 1, wherein the registration structure comprises an embossed structure formed in the back sheet.

6. The label assembly according to claim 5, wherein the embossed structure comprises a raised score line.

7. The label assembly according to claim 1, wherein the registration structure comprises a tab cut into at least the back sheet, the tab being disposed outside of the outer periphery of the removable panel and aligned with the removable panel, wherein the tab is raisable by folding outward above the back sheet.

8. The label assembly according to claim 1, wherein the registration structure comprises a pair of spaced apart tabs each defined on three sides by a tearable line of separation in both the back sheet and the face sheet, wherein the tabs are each disposed outside of the outer periphery of the removable panel and raisable by folding outward above the back sheet.

9. A label assembly, comprising:

a face sheet having a printable surface and an adhesive material coating a surface opposite the printable surface;

a label shape defined in the face sheet by first tearable lines of separation;

a back sheet disposed over the adhesive material, the back sheet including a first surface opposite the adhesive material, a removable panel defined in the first surface by second tearable lines of separation and disposed over the label shape, and a remaining portion disposed around the removable panel;

a registration structure comprising a tab cut into the remaining portion of the back sheet and aligned with an outer edge of the removable panel, the tab one of raised or raisable above the back sheet first surface by folding outward above the back sheet.

10. The label assembly according to claim 9, further comprising a plurality of label shapes, each of the plurality of label shapes associated with a removable panel and a registration structure.

11. The label assembly according to claim 9, wherein the removable panel is sized larger than the label shape.

12. The label assembly according to claim 9, wherein the registration structure comprises a pair of spaced apart tabs each defined on three sides by a tearable line of separation in both the back sheet and the face sheet, wherein the tabs are raisable by folding outward above the back sheet.

13. A method for labeling an object having a non-planar surface, the method comprising:

providing a label assembly including a face sheet, a back sheet, and an adhesive material between the face and back sheets, the face sheet including a printable surface opposite the back sheet and a label shape defined in the printable surface by first tearable lines of separation, the back sheet including a first surface opposite the face sheet, a removable panel defined in the first surface by second tearable lines of separation and disposed over the label shape, the label assembly further including a registration structure formed in the back sheet and aligned with the removable panel;

removing the removable panel to expose the adhesive material on the label shape;

placing the object on the back sheet and against the registration structure to align the object with the exposed adhesive material; and rolling the object across at least a portion of the label shape to contact the non-planar surface to the adhesive material and adhere the label shape to the non-planar surface of the object.

14. The method of claim 13, wherein the label shape separates from the face sheet during the rolling of the object.

15. The method of claim 13, further comprising placing the printed face sheet downward on a surface before placing the object against the registration structure.

16. The method of claim 13, further comprising raising the registration structure above the first surface of the back sheet.

17. The method of claim 13, further comprising routing a label assembly through a printer and printing on the label shape before removing the removable panel.

18. The label assembly according to claim 9, wherein the registration structure comprises a pair of spaced apart tabs each defined by at least one tearable line of separation cut in the remaining portion of the back sheet, wherein each of the spaced apart tabs is disposed outside of the outer periphery of the removable panel and is raisable by folding outward above the back sheet.

19. The label assembly according to claim 18, wherein each of the spaced apart tabs is defined on three sides by a tearable line of separation cut in the remaining portion of the back sheet and the face sheet.

20. The label assembly according to claim 1, wherein the back sheet is formed of a material to which the adhesive coating adheres significantly less than to the face sheet.

* * * * *